United States Patent [19]

De Keyzer et al.

[11] Patent Number: 4,720,447

[45] Date of Patent: Jan. 19, 1988

[54] SILVER SALT DIFFUSION TRANSFER REVERSAL PROCESS

[75] Inventors: René M. De Keyzer, Bornem; Leon L. Vermeulen, Herenthout; Robert J. Pollet, Vremde, all of Belgium

[73] Assignee: AGFA-Gevaert, N.V., Mortsel, Belgium

[21] Appl. No.: 917,107

[22] Filed: Oct. 9, 1986

[30] Foreign Application Priority Data

Oct. 10, 1985 [EP] European Pat. Off. ..... 85201654

[51] Int. Cl.[4] ..... G03C 5/54

[52] U.S. Cl. ..... 430/244

[58] Field of Search ..... 430/244, 219

[56] References Cited

U.S. PATENT DOCUMENTS 4,309,499 1/1982 Takagi et al. ..... 430/244

*Primary Examiner*—J. David Welsh

*Attorney, Agent, or Firm*—A. W. Breiner

[57] ABSTRACT

Method of making images by image-wise exposing a silver halide emulsion layer, developing it with an alkaline processing solution in the presence of a silver halide solvent and causing silver complexes to diffuse from the emulsion layer into a non-light-sensitive image-receiving layer in the presence of development nuclei thereby to form a silver transfer image in that layer, said transfer image formation occurring in the presence of at least one heterocyclic azole compound, which influences the density and tone of said transfer image, said compound being contained in said image-receiving layer and/or in said processing solution and being a heterocyclic azole corresponding to the general formula:

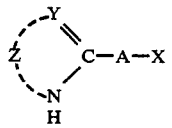

wherein Y is =N— or =HC—; Z represents atoms completing a heterocycle; A is a chemical bond or the group $—(L^1)_n—Alk—(L^2)_m—$ wherein n is 0 or 1, $L^1$ is —S—, Alk is alkylene, which can be substituted and/or interrupted by hetero atom(s) or group(s) containing a hetero atom, arylene, or alkenylene; m is 0 or 1, $L^2$ is —S—, —Se—, or $—N(R^2)—$, wherein $R^2$ is H or alkyl; X is alkyl, alkenyl, aryl, or heterocyclyl, which can be substituted; and wherein water-solubilizing group(s) can be present in said azole. The invention also provides an image-receiving layer and/or a processing solution incorporating such azole.

9 Claims, No Drawings

SILVER SALT DIFFUSION TRANSFER REVERSAL PROCESS

The present invention relates to the photographic silver complex diffusion transfer reversal process (DTR process), in particular to a method for improving the density and the tone of positive images, produced according to the DTR-process, in the image-receiving layer and also relates to a non-light-sensitive element or a processing solution comprising density- and/or tone-controlling compounds.

The principles of the silver complex diffusion transfer reversal process, hereinafter called DTR-process, have been described e.g. in the U.S. Pat. No. 2,352,014.

In the DTR-process silver complexes are transferred by diffusion from a light-sensitive silver halide emulsion layer to an image-receiving layer, in which they are converted into a silver image by the action of development nuclei. For this purpose, an image-wise exposed silver halide emulsion layer is developed by means of a processing solution in the presence of (a) developing agent(s) and a silver ion complexing agent, also called silver halide solvent. The silver halide in the exposed parts of a negative emulsion layer is developed to silver so that it cannot dissolve anymore and consequently cannot diffuse. The silver halide in the unexposed parts of such negative emulsion layer is converted into soluble silver complexes by means of the silver halide solvent acting as a silver complexing agent. The soluble silver complexes are transferred by diffusion to an adjacent image-receiving layer or an image-receiving layer brought into effective contact with the emulsion layer, to form in the presence of development nuclei that catalyze the reduction of transferred complexed silver ions a positive silver image or silver-containing image in the receiving layer. When instead of a negative silver halide emulsion layer a direct-positive silver halide emulsion layer is used, the silver halide in the unexposed areas is developed and the silver halide in the exposed areas is transferred, as described hereinbefore, to form a negative silver image in the image-receiving layer. By "effective contact" is understood that dissolved silver salts can migrate by diffusion from the emulsion layer to the image-receiving layer, if desired, through an intermediate layer provided between this emulsion layer and this image-receiving layer. Whenever such intermediate layer is present, it must not impede the diffusion of the silver salts.

More details on the DTR-process can be found in "Photographic Silver Halide Diffusion Processes" by A. Rott and E. Weyde, Focal Press, London, New York (1972).

Unfortunately, the density of the image formed in the image-receiving layer is sometimes unsatisfactory and the image tone may often be unpleasant e.g. brownish.

Many attempts have therefore been made to improve the density and/or the tone of the resulting image.

For example, the U.S. Pat. No. 3,042,514 describes the use of organic sulphur compounds e.g. phenyl-mercapto-tetrazole in the image-receiving layer.

In the BE patent specification No. 751,786 the use of heterocyclic dimercapto compounds is described for improving the stability of silver images formed in the image-receiving layer.

In the U.S. Pat. No. 4,310,613 the use of certain quaternary ammonium compounds is said to improve transmission density but likely to impair reflection density.

By the terms "transmission density" and "reflection density" as used herein are meant the diffuse transmission density and the diffuse reflection density respectively. The diffuse transmission density is measured according to the requirements of American Standard PH 2.19-1959. The diffuse reflection density is measured according to the requirements of American Standard PH 2.17-1958.

Reflection density is influenced by the speed of image formation. This speed of image formation has an influence on the density build-up, on the speed of deposition of the image particles, on the concentration of the deposited image particles, on the depth of the deposition in the image-receiving layer, and on the form of the image particles. The density build-up of the image in the image-receiving layer should be such that incident light is not scattered by metallic particles at its surface so as to avoid any bronzing effect and thus to ensure a substantially neutral tone. In contrast, scattering of incident light by image particles that lie deeper in the transfer image must occur if the transfer image is to have a high reflection density. To promote interior rather than surface scattering the physical development of silver should be homogeneous within the layer. At the same time, the development must not substantially decrease the transmission density.

Many proposed compounds, although offering positive effects with respect to density and tone, are unacceptable in other respects. For instance, certain compounds have a tendency to cause formation of sludge. The quaternary ammonium salts described in the above-mentioned JP patent application No. 57/78,536, even though they may improve the reflection density, can be synthesized only with great difficulty and as a consequence, they are hardly suitable from an economical standpoint. Moreover, they have a slight retarding effect on the diffusion transfer speed.

There thus remains a need to provide compounds that assist in the formation of high-quality images according to the DTR-process, in other words images having a high reflection density, but which compounds do not have any significant adverse side effects like that of retarding the diffusion transfer speed. At the same time, such compounds should be easily and economically synthesizable.

It has been found now that certain heterocyclic azoles can enhance the reflection density whilst not substantially decreasing the transmission density of transfer images formed by the DTR-process, at the same time improve the tone of such transfer images and do not retard the diffusion transfer speed. These compounds can be prepared easily and economically.

Accordingly there has been found a method of making a DTR-image comprising image-wise exposing a photosensitive element comprising a photographic silver halide emulsion layer, developing the exposed emulsion layer with the aid of an alkaline processing solution in the presence of a silver halide solvent and causing silver complexes to diffuse from the emulsion layer into a non-light-sensitive image-receiving layer in the presence of development nuclei thereby to form a silver transfer image in that layer, said transfer image formation occurring in the presence of at least one heterocyclic azole, which influences the density and tone of said transfer image, characterized in that said heterocyclic azole is contained in said non-light-sensitive image-receiving layer or a non-light-sensitive hydrophilic colloid layer in water-permeable relationship therewith and/or in said alkaline processing solution and that it is a unidentate, bidentate, or polydentate heterocyclic azole reagent for silver that does not carry a mercapto group or the tautomeric thione thereof and corresponds to the following general formula I:

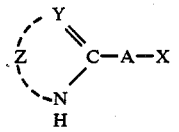

(I)

wherein:

Y represents the ring member =N— or =HC—;

Z represents the atoms completing a heterocycle or a substituted heterocycle, which heterocycle may carry a fused on aromatic ring system e.g. the atoms completing an imidazole nucleus, a benzimidazole nucleus, a naphthimidazole nucleus, a triazole nucleus, a tetrazole nucleus, an imidazopyridine nucleus, an imidazoline nucleus, a pyrazole nucleus, etc.;

A represents a chemical bond or the group $—(L^1)_n—Alk—(L^2)_m—$ wherein n is 0 or 1, $L^1$ is —S—, Alk represents an alkylene group e.g. methylene, ethylene, trimethylene, tetramethylene, a substituted alkylene group, an alkylene group interrupted by at least one hetero atom or a group containing a hetero atom such as —S—, —O—, $—SO_2—$, and $—N(R^1)—$, $R^1$ being hydrogen or a $C_1$–$C_4$alkyl group e.g. methyl and ethyl, an arylene group e.g. phenylene and pyridylene, or an alkenylene group e.g. vinylene, m is 0 or 1, $L^2$ is —S—, —Se—, or $—N(R^2)—$, wherein $R^2$ has a significance as defined above for $R^1$;

X represents a $C_1$–$C_{18}$alkyl group e.g. methyl, ethyl, propyl, and butyl, a substituted $C_1$–$C_{18}$alkyl group e.g. 1,3-dimethylbutyl, a $C_1$–$C_{18}$alkenyl group e.g. allyl, a substituted $C_1$–$C_{18}$alkenyl group, an aryl group e.g. phenyl, a substituted aryl group, or a heterocycle or substituted heterocycle, which heterocycle may carry a fused on aromatic ring system, e.g. tetrazolyl, triazolyl, pyridyl, pirazinyl, thienyl, imidazolyl, imidazolinyl, benzimidazolyl, quinolyl; and wherein at least one water-solubilizing group, more particularly a —COOM or $—SO_3M$ group with M is hydrogen, ammonium, a metal atom, or an organic amine, can be linked directly or indirectly to the molecule of said heterocyclic azole.

In the heterocyclic azole compounds as defined above the nitrogen ligand atom of the —NH— moiety linked to Z can form a salt-forming bond with silver. Additionally, a second ligand atom is present in the case of the bidentate heterocyclic azole compounds corresponding to the above general formula I. This second ligand atom is present in the moiety —A—X and it can form a salt-forming bond or a complex-forming bond with silver. It is, of course, also possible that in some of the heterocyclic azole compounds used in accordance with the present invention more than two ligand atoms are present. This is the case when a ligand-containing link joins two heterocyclic azole ring structures. An example of a polydentate is e.g. bis-[2-(5-sulpho-2-benzimidazolylthio)-ethyl]-sulphide (compound 53).

The present invention also provides a non-light-sensitive element comprising an image-receiving layer incorporating at least one heterocyclic azole compound corresponding to the above general formula I.

The present invention also provides a processing solution comprising at least one heterocyclic azole compound corresponding to the above general formula I.

It has been established that the heterocyclic azole compounds corresponding to the above general formula I, when present in effective amounts in the non-light-sensitive image-receiving layer and/or in the alkaline processing solution during the diffusion transfer, enhance the diffusibility of the silver complexes, in consequence of which the latter tend to diffuse deeper into the image-receiving layer before forming the diffusion transfer image. As a consequence, the internal and external light scattering by the transfer image particles reach a balance that results in an advantageous, low refection, which greatly adds to the appreciability of the density- and/or tone of the image.

For use in accordance with the present invention the heterocyclic azole compounds as defined above are incorporated advantageously into the non-light-sensitive element comprising an image-receiving layer and/or they are added to the processing solution.

Representatives of the heterocyclic azole compounds corresponding to the above general formula I that can be used in accordance with the present invention are listed in the following Table 1.

TABLE 1

| Compound No | |
|---|---|
| 1 | 2-nonyl-5-sulpho-benzimidazole |
| 2 | 2-tridecyl-5-sulpho-benzimidazole |
| 3 | 2-pentadecyl-5-sulpho-benzimidazole |
| 4 | 2-heptadecyl-5-sulpho-benzimidazole |
| 5 | 2-hexadecylthiomethyl-5-sulpho-benzimidazole |
| 6 | 2-methylthiomethyl-5-sulpho-benzimidazole |
| 7 | 2-(2-ethylthioethylthio)-5-sulpho-benzimidazole |
| 8 | 2-(2-methylthioethyl)-6-sulpho-benzimidazole |
| 9 | 2-(3-methylthio-n-propyl)-6-sulpho-benzimidazole |
| 10 | 2-methylthiomethyl-5-carboxy-benzimidazole hydrochloride |
| 11 | 2-(3-sulphopropylthiomethyl)-benzimidazole |
| 12 | 2-[2(3-sulphopropylthio)ethyl]-benzimidazole |
| 13 | 2-carboxymethylthiomethyl-benzimidazole |
| 14 | 2-(sulphobutylthiomethyl)-benzimidazole |
| 15 | 2-(1,3-dimethyl-3-sulpho-n-butylthiomethyl)-benzimidazole |
| 16 | 2-(3-sulphoprophylthiomethyl)-5-sulpho-benzimidazole |
| 17 | 2-[3-(3-sulphopropylthio)propyl]-benzimidazole |
| 18 | 2-phenylthiomethyl-5-sulpho-benzimidazole |
| 19 | 2-[-2-(ethylthio)ethylthio]-5-sulpho-benzimidazole |
| 20 | 2-(tetrahydro-2-thienyl)-5-sulpho-benzimidazole |
| 21 | 2-(3-sulphopropylthiomethyl)-5-carboxy-benzimidazole |
| 22 | 2-(o-methylthiophenyl)-5-sulpho-benzimidazole |
| 23 | 2-allylthiomethyl-5-sulpho-benzimidazole |
| 24 | 2-phenylselenomethyl-5-sulpho-benzimidazole |
| 25 | 2-(3-pyridyl)-5-sulpho-benzimidazole.½ hydrate |
| 26 | 2-(4-sulpho-2-pyridyl)-benzimidazole |
| 27 | 1-ethyl-2-(2-pyridyl)-5-sulpho-benzimidazole |
| 28 | 2-(2-benzimidazolylmethylthio)-5-sulpho-benzimidazole |
| 29 | 2-(2-quinolyl)-5-sulpho-benzimidazole |
| 30 | 2-pyrazinyl-5-sulpho-benzimidazole |
| 31 | 2-(4-thiazolylmethyl)-5-sulpho-benzimidazole |
| 32 | 2-(2-Delta$_2$-imidazolinyl)-5-sulpho-benzimidazole |
| 33 | 2-(tetrazolylmethylthio)-5-sulpho-benzimidazole |
| 34 | 2-(2-pyridylmethylthio)-5-sulpho-benzimidazole |
| 35 | 2-(2-pyridylthiomethyl)-5-sulpho-benzimidazole |
| 36 | 2-diethylaminomethyl-benzimidazole |
| 37 | 2-(5-amino-n-pentyl)-benzimidazole |
| 38 | 2-(2-amino-ethylthio)-benzimidazole |
| 39 | 2-(2-dimethylaminoethylthio)-benzimidazole |
| 40 | sodium salt of 2-(2-dimethylaminoethylthio)-5-sulpho- |

TABLE 1-continued

| Compound No | |
|---|---|
| | benzimidazole |
| 41 | sodium salt of 2-(2-diethylaminoethylthio)-5-sulpho-benzimidazole |
| 42 | sodium salt of 2-morpholinoethylthio-5-sulpho-benzimidazole |
| 43 | 2-(2-dimethylaminoethylthiomethyl)-benzimidazole |
| 44 | 2-(2-dimethylaminoethylthiomethyl)-5-sulpho-benzimidazole sodium salt |
| 45 | 2-(2-pyridyl)-6-sulpho-benzimidazole.1.5 hydrate |
| 46 | 2-(4-pyridyl)-6-sulpho-benzimidazole.⅔ phosphoric acid |
| 47 | 2-(4-pyridyl)-6-sulpho-benzimidazole monohydrate |
| 48 | 2-(4-sulpho-2-pyridyl)-5-sulpho-benzimidazole dihydrate |
| 49 | 2-[Beta-(2-pyridyl)-vinyl]-5-sulpho-benzimidazole hydrochloride monohydrate |
| 50 | 2-(2-imidazolyl)-5-sulpho-imidazole |
| 51 | 2-benzimidazolylmethylthio-succinic acid monohydrate |
| 52 | bis-(5-sulpho-2-benzimidazolylmethyl)-sulphide |
| 53 | bis-[2-(5-sulpho-2-benzimidazolylthio)-ethyl]-sulphide |
| 54 | 3-(3-sulphopropylthio)-5-methylthiomethyl-1H—1,2,4-triazole |
| 55 | 3-(3-sulphopropylthio)-5-[-2-(ethylthio)ethylthio]-1H—1,2,4-triazole |
| 56 | 1,2-bis-(6-sulpho-2-benzimidazolyl)-ethane |
| 57 | 1,3-bis-(6-sulpho-2-benzimidazolyl)-propane |
| 58 | 1,4-bis-86-sulpho-2-benzimidazolyl)-butane |
| 59 | 2,6-bis-(6-sulpho-2-benzimidazolyl)-pyridine monohydrate |
| 60 | 2-(5-sulpho-2-benzimidzolyl):3H—imidazo[4,5-b]-pyridine |
| 61 | 2-(2-pyridyl)-7-sulpho-1H—naphtho[1,2-d]-imidazole |
| 62 | 2-[o-(3-sulphopropylthio)phenyl]-Delta$_2$-imidazoline |
| 63 | 1,2-bis-[5-83-sulphopropylthio)-1H—1,2,4-triazol-3-yl]-ethane disodium salt |
| 64 | 1,2-bis-[5-(1,3-dimethyl-3-sulphobutylthio)-1H—1,2,4-triazol-3-yl]-ethane disodium salt |
| 65 | 3-(m-sulphophenyl)-5-(2-pyridyl)-pyrazole |
| 66 | 3-sulpho-5-(4-pyridyl)-1H-1,2,4-triazole |
| 67 | 3-(3-sulphopropylthio)-5-(4-pyridyl)-1H—1,2,4-triazole |
| 68 | 2-pyrazinyl-tetrazole |
| 69 | 2-(2-dimethylaminoethylthio)-tetrazole |
| 70 | bis-(6-sulpho-2-benzimidazolylthio)-methane disodium salt |
| 71 | 1,2-bis-(2-benzimidazolyl)-ethane sulphonic acid sodium salt |
| 72 | 1,3-bis-[5-(3-sulphopropylthio)-1H 1,3,4-triazol-2-yl]-propane |
| 73 | 1,3-bis-(5-sulpho-1H—1,3,4-triazol-2-yl)-propane |
| 74 | 1,4-bis-(tetrazolyl)-butane |
| 75 | N—methyl-N,N—bis-(2-benzimidazolylmethyl)-amine |
| 76 | N,N—bis-(5-sulpho-2-benzimidazolylmethyl)-methylamine |
| 77 | N—methyl-N,N—bis-[2-(2-benzimidazolylthio)-ethyl]-amine |
| 78 | N—methyl-N,N—bis-[2-(2-benzimidazolylthio)-ethyl]-amine sulphonic acid |

The heterocyclic azole compounds as defined above can be prepared as described in the U.S. Pat. Nos. 3,667,957 and 3,808,005 and in the Research Disclosure No. 23630 of December 1983, pages 382–383. According to the latter patent specifications and research disclosure heterocyclic azole compounds of this type can be incorporated as fog-inhibitors or stabilizers into light-sensitive silver halide emulsions including silver halide emulsions suited for DTR-processes or they can be added in fog-inhibiting amounts to solutions for developing exposed silver halide emulsions.

In order to make possible a rapid formation of silver complexes with the aid of the silver halide solvent, the silver halide of the photographic silver halide emulsion of the photosensitive element used in accordance with the present invention preferably consists of at least 70 mole % of silver chloride, the remainder being preferably silver bromide. The average silver halide grain size can e.g. be in the range of 200–300 nm.

A suitable coverage of silver halide expressed in g of silver nitrate per $m^2$ is in the range of 1 to 5 $g/m^2$.

The binder of the photographic silver halide emulsion layer preferably is gelatin. But instead of or together with gelatin, use can be made of one or more other natural and/or synthetic hydrophilic colloids e.g. albumin, casein, zein, polyvinyl alcohol, alginic acids or salts thereof, cellulose derivatives such as carboxymethyl cellulose, modified gelatin, etc. The weight ratio of hydrophilic colloid to silver halide expressed as equivalent amount of silver nitrate in the silver halide emulsion layer(s) of the photosensitive element can e.g. be between 1:1 and 10:1.

In addition to the binder and the silver halide, the photosensitive element may contain in the photographic silver halide emulsion layer and/or in one or more layers in water-permeable relationship therewith any of the kinds of compounds customarily used in such layers for carrying out the DTR-process. Such layers may comprise e.g. one or more developing agents, coating aids, stabilizing agents or fog-inhibiting agents e.g. as described in the U.S. Pat. Nos. 3,667,957 and 3,808,005 and in the Research Disclosure No. 23630 of December 1983, plasticizers, development-influencing agents e.g. polyoxyalkylene compounds, onium compounds, and thioether compounds as decribed in the U.S. Pat. Nos. 2,938,792; 3,021,215; 3,038,805; 3,046,134; 4,013,471; 4,072,523; 4,072,523; 4,072,526; 4,292,400, and in the DE Patent specification No. 1,124,354, hardeners, spectral sensitizing agents, etc.

A suitable spectral sensitizing agent for use in the photographic silver halide emulsion layer is the compound corresponding to the following structural formula II:

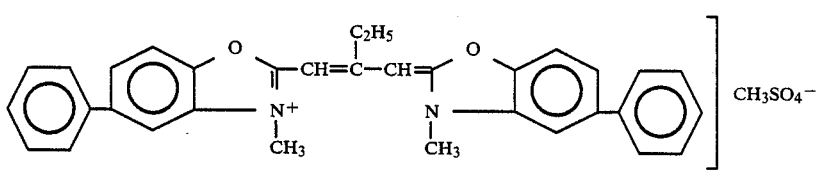

(II)

Other interesting spectral sensitizing agents for use in photographic silver chloride emulsions that have an average grain size higher than 0.5 um and that have been hardened by means of formaldehyde are the compounds corresponding to the following structural formulae III and IV:

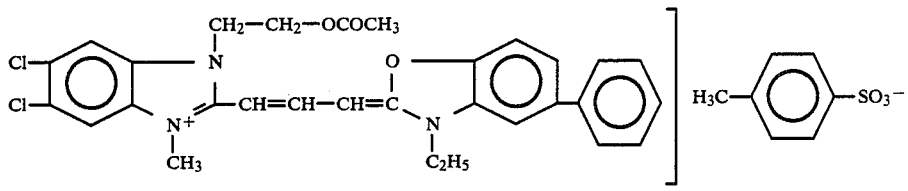

(III)

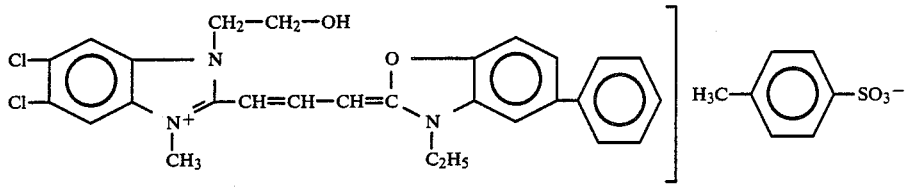

(IV)

With respect to the hardening of photographic hydrophilic colloid silver halide emulsions it has been established that vinylsulphonyl compounds described in, e.g. DE-OS No. 2,749,260, DE patent specification No. 1,808,685, DE-OS No. 2,348,194 and Research Disclosure No. 22,507 of January 1983, e.g. vinylsulphonyl compounds of the formula $(CH_2{=}CH{-}SO_2)_2{-}R$, wherein R is $-CH_2-CH_2-O-CH_2-CH_2-$, $-(CH_2)_n-$ with n is 1 to 6, or $CH_3O(CH_2)_2-CH{=}$, unexpectedly also have a hardening effect when present in acid coating conditions of said emulsions.

The support of the photosensitive element used in accordance with the present invention can be of any of the support materials customarily employed in the art. They include paper, glass or film, e.g. cellulose acetate film, polyvinyl acetal film, polystyrene film, polyethylene terephthalate film etc. as well as metal supports and metal supports laminated on both sides with paper. Paper supports coated on one or both sides with an Alpha-olefin polymer, e.g. polyethylene, are used preferably. In order to compensate for the curling tendency of the photosensitive element, one side of its support can be coated with a polyethylene layer, whose specific density and/or thickness differ from those measured at the other side of the support. This compensation for the curling tendency can be improved by application of a hydrophilic colloid anti-curling layer optionally incorporating matting agents.

The emulsion-coated side of the photosensitive element can be provided with a top layer that contains water-permeable colloids. Such top layer will usually be free of gelatin. It must be of such nature that the diffusion is not inhibited or restrained. Such layer may act e.g. as an antistress layer. Appropriate water-permeable binding agents for a layer coated on top of the photographic silver halide emulsion layer are e.g. methyl cellulose, the sodium salt of carboxymethyl cellulose, hydroxyethyl cellulose, hydroxyethyl starch, hydroxypropyl starch, sodium alginate, gum tragacanth, starch, polyvinyl alcohol, polyacrylic acid, polyacrylamide, polyvinyl pyrrolidone, polyoxyethylene, copoly(methylvinylether/maleic acid), etc. The thickness of this layer depends on the nature of the colloid used. Such layer, if present, may be transferred at least partially to the image-receiving layer when the DTR-process comes to an end.

The silver halide emulsion of the photosensitive element used in accordance with the present invention is prepared in a known way by precipitation reaction of halides, e.g. ammonium halide, potassium, sodium, lithium, cadmium and strontium halide with silver salts, e.g. silver nitrate, in a hydrophilic protective binder, preferably gelatin. In case developing agents are to be incorporated into the silver halide emulsion, they are added to the emulsion composition preferably after the chemical ripening stage following the washing of the emulsion.

The DTR-image can be formed in the image-receiving layer of a so-called single-support-element, also called mono-sheet element, which contains the photographic silver halide emulsion layer(s) and the image-receiving layer in water-permeable relationship, e.g. on top of each other, or the DTR-image can be formed in an image-receiving layer of a separate element, which is brought into contact with the photosensitive element preparatory to the silver complex diffusion.

Examples of mono-sheet elements comprising a light-shielding pigment layer have been described in the DE patent specification No. 1,772,603 and the U.S. Pat. Nos. 3,629,054 and 3,928,037.

In the case of a separately supported image-receiving layer this layer can be coated on an opaque or transparent support, which can be one of the supports described hereinbefore for the photosensitive element.

It is also possible to obtain at least two transfer images from one silver halide emulsion during only one single imbibition step by the combined use of a mono-sheet element and a second element comprising a separately supported image-receiving layer. In that case the mono-sheet element may consist of a layer pack comprising in the given order: a transparent film support e.g. a polyethylene terephthalate support, an image-receiving layer, a light-shielding pigment layer e.g. a layer containing titanium oxide, and a silver halide emulsion layer e.g. a negative-working silver halide emulsion layer, whereas the second element may comprise a transparent film support e.g. a polyethylene terephthalate support, and an image-receiving layer. For anti-curling purposes as well as for convenience the film support may carry an image-receiving layer on either side. It is self-evident that the mono-sheet element as well the second element may comprise other conventional layers e.g. subbing layers.

The image-receiving layer(s) or (a) layer(s) adjacent thereto and in water-permeable relationship therewith may contain one or more agents for promoting the reduction of the diffusing silver complexes into metallic silver, these agents being called development nuclei. Such development nuclei have been described in the above-mentioned book by A. Rott and E. Weyde on pages 54–57. Suitable development nuclei are e.g. colloidal silver, heavy metal sulphides e.g. cobalt sulphide, zinc sulphide, nickel sulphide, silver nickel sulphide. A preferred type of development nuclei are silver nickel sulphide nuclei. The development nuclei can also be incorporated into the processing liquid as described in GB patent specification No. 1,001,558, filed Apr. 13, 1962 by Gevaert Photo-Producten N.V.

The heterocyclic azole compounds corresponding to the above general formula I can be incorporated into the non-light-sensitive image-receiving layer in amounts of 1 mg to 200 mg per $m^2$. Preferably, they are incorporated into the non-light-sensitive image-receiving layer in amounts of 10 mg to 100 mg per $m^2$. They can also be incorporated in equivalent operative amounts into a non-light-sensitive hydrophilic colloid layer that is in water-permeable relationship with the image-receiving layer.

In one or more layers of the non-light-sensitive element comprising an image-receiving layer, substances can be incorporated, which play a contributory part in the formation of the diffusion transfer images. Such substances include black-toning agents, e.g. those described in GB patent specification No. 561,875, filed Dec. 3, 1942 by Ilford Ltd. and in BE patent specification No. 502,525 filed Apr. 12, 1951 by Agfa A. G.

The image-receiving layer may consist of or comprise any of the binders mentioned hereinbefore for the silver halide, gelatin being the preferred binder for the image-receiving layer.

The non-light-sensitive element may in the image-receiving layer or in a hydrophilic colloid layer in water-permeable relationship therewith comprise a silver halide solvent, e.g. sodium thiosulphate in an amount of approximately 0.1 g to approximately 4 g per $m^2$.

The non-light-sensitive element may in the image-receiving layer or in a hydrophilic colloid layer in water-permeable relationship therewith comprise colloidal silica.

The image-receiving layer may have been hardened to achieve enhanced mechanical strength. Appropriate hardening agents for hardening the natural and/or synthetic hydrophilic colloid binding agents in the image-receiving layer include e.g. formaldehyde, glyoxal, mucochloric acid, and chrome alum. Hardening can also be effected by incorporating a hardener precursor in the image-receiving layer, the hardening of the hydrophilic colloid therein being triggered by the treatment with the alkaline processing liquid. Other suitable hardening agents for hardening the hydrophilic colloid binding agents in the image-receiving layer are vinylsulphonyl hardeners such as those described hereinbefore for the hardening of photographic hydrophilic colloid silver halide emulsions.

The image-receiving layer may also comprise plasticizers, optical brighteners, and substances improving its adherence to the support.

The adherence to resin film supports or paper supports of layers containing colloidal silica ($SiO_2$) can be improved with epoxysilane compounds, e.g. a compound having the following structural formula V:

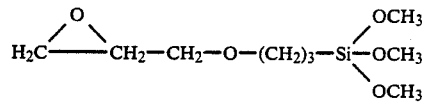

(V)

For instance the adherence of an image-receiving layer to a film or paper support can be improved considerably by the presence in such image-receiving layer of a combination of colloidal silica and an above-mentioned epoxysilane. A preferred combination is that of silica and the epoxysilane corresponding to formula V. This specific combination is called $SiO_2$/epoxysilane hereinafter. The adherence can also be improved with a dihydroxybenzene e.g. resorcinol and/or with succinimide. The adherence can be further improved by combining colloidal silica, an epoxysilane, a dihydroxybenzene, and succinimide in the image-receiving layer.

It is also found surprisingly that, when at least one of the group consisting of the combination of colloidal silica and an epoxysilane e.g. the above-mentioned /epoxysilane combination, a dihydroxybenzene, and succinimide was incorporated into the image-receiving layer and/or into a hydrophilic colloid covering layer coated thereon and in water-permeable relationship therewith, the reflection density of the image obtained was enhanced. An even more enhanced reflection density can be achieved advantageously by combining the use of at least one density- and tone-controlling compound in accordance with the present invention with the use of at least one of the group consisting of the combination of colloidal silica and an epoxysilane e.g. the above-mentioned $SiO_2$/epoxysilane combination, a dihydroxybenzene, and succinimide in the image-receiving layer and/or in a hydrophilic colloid covering layer coated thereon and in water-permeable relationship therewith.

Furthermore, the combination of colloidal silica ($SiO_2$) with epoxysilane compounds, e.g. the compound having the above structural formula V, also offers a very interesting non-diffusing hardener composition for use in hydrophilic colloid covering layers or antistress layers of photographic silver halide emulsion layers.

It has also been found that the addition of at least one salt selected from the group consisting of sodium bromide, potassium bromide, and potassium iodide to a hydrophilic colloid covering layer coated on top of the image-receiving layer could also enhance the reflection density of the transfer image obtained.

The non-light-sensitive element may, in the image-receiving layer in operative contact with the developing nuclei, contain thioether compounds such as those described in GE patent specification No. 1,124,354, in U.S. Pat. Nos. 4,013,471 and 4,072,526, and in the published EU patent application No. 0,026,520.

The non-light-sensitive element comprising an image-receiving layer may be provided with printing matter, e.g. with any type of recognition data applied by any type of conventional printing process such as offset printing, intaglio printing, etc.

For further information relevant to the composition of the image-receiving layer there can be referred to the above-mentioned book by André Rott and Edith Weyde p.50–65.

Preferred image-receiving layer compositions for use in accordance with the present invention comprise gelatin as binding agent, silver nickel sulphide development nuclei, and at least one heterocyclic azole compound as defined above.

The processing solution for effecting the development of the exposed silver halide in the emulsion layer of the photosensitive element and the diffusion transfer of the silver complexes to the non-light-sensitive element is an alkaline solution.

The heterocyclic azole compounds as defined above can be added to the alkaline processing solution in amounts of 5 mg to 500 mg per liter. Preferably, they are added thereto in amounts of 10 mg to 100 mg per liter.

The developing agent or a mixture of developing agents can be incorporated into the alkaline processing solution and/or into the photosensitive element comprising a photographic silver halide emulsion layer and/or into the non-light-sensitive element comprising an image-receiving layer. When incorporated into the photosensitive element, the developing agent(s) can be present in the silver halide emulsion layer or are preferably present in a hydrophilic colloid layer in water-permeable relationship therewith, e.g. in an anti-halation layer adjacent to the silver halide emulsion layer of the photosensitive element. When incorporated into the non-light-sensitive element comprising an image-receiving layer, the developing agent(s) can be present in the image-receiving layer or in a hydrophilic colloid layer in water-permeable relationship therewith. In case the developing agent or a mixture of developing agents is contained in the photosensitive element and/or in the non-light-sensitive element, the processing solution is merely an aqueous alkaline solution that initiates and activates the development.

Suitable developing agents for the exposed silver halide are e.g. hydroquinone-type and 1-phenyl-3-pyrazolidone-type developing agents as well as p-monomethylaminophenol.

The silver halide solvent, preferably sodium thiosulphate, can be incorporated into the non-light-sensitive element as mentioned above, but also integrally or partly into the alkaline processing solution. When present in the alkaline processing solution, the amount of silver halide solvent is in the range of e.g. 10 g/l to 50 g/l.

The alkaline processing solution usually contains alkaline substances such as tribasic phosphate, preserving agents e.g. sodium sulphite, thickening agents e.g. hydroxyethylcellulose and carboxymethylcellulose, fog-inhibiting agents such as potassium bromide, silver halide solvents e.g. sodium or ammonium thiosulphate, black-toning agents especially heterocyclic mercapto compounds. The pH of the processing solution is preferably in the range of 10 to 14.

With respect to alkaline substances for use in the alkaline processing solution, combinations of sodium carbonate with sodium hydroxide and/or 2-methylamino-ethanol were found to be advantageous because of improved buffering action and retarded exhaustion of the processing solution.

For particulars about exposure and developing apparatus, which may be applied in the DTR-process according to the present invention reference is made e.g. to "Photographic Silver Halide Diffusion Processes" by A. Rott and E. Weyde, Focal Press London, New York 1972 and to patent literature cited therein.

The photographic elements for use in accordance with the present invention can be used in the form of roll film or sheet film or in the form of a filmpack e.g., for in-camera-processing.

The photographic elements used in accordance with the present invention can also be destined for the production of identification documents according to the DTR-process. Such identification documents contain a photograph and/or identification data formed by diffusion transfer in an image-receiving layer on a polyethylene-covered paper support, which to exclude any forgery by alteration of the identification data and/or photograph, is laminated to a transparent protective cover sheet. The transparent protective cover sheet usually is a thermoplastic resin sheet such as a polyester film sheet, e.g. a polyethylene terephtalate film sheet, which is coated with polyethylene at the side that is to be laminated against the image-receiving-layer carrying the identification data. It has been experienced unfortunately that the unwinding of such polyethylene-coated polyester film sheet, when in wound up condition on reels, is rather difficult because the rear polyester side of the film sheet tends to stick to the opposite polyethylene-coated side. To avoid this disturbing sticking the rear polyester side of the film sheet can be coated with a very thin antisticking layer prior to the application of the polyethylene coating to the front side and before the transverse stretching of the polyester film sheet.

The following examples illustrate the present invention. The ratios and percentages given therein are by weight unless otherwise stated. The compound numbers used in these examples denote the compounds identified by those numbers in Table 1 herein.

EXAMPLE 1

A gelatin silver chloride emulsion (gelatin/silver nitrate=1.67), hardened in the usual way with formaldehyde, was coated at 45° C. on a polyethylene-covered paper support of 140 g per $m^2$ in such a way that an amount of silver chloride equivalent to 0.6 g of silver nitrate is present per $m^2$.

The dry emulsion layer was covered with the following top layer composition at a ratio of 1 l per 20 $m^2$ and a temperature of 45° C.:

| | |
|---|---|
| demineralized water | 800 ml |
| hydroxyethyl starch having a substitution degree of 0.27 hydroxyethyl groups | 40 g |
| ethanol | 200 ml |
| 1-phenyl-3-pyrazolidone | 5 g |
| hydroquinone | 10 g |
| 20% aqueous formaldehyde | 10 ml |

The resulting photosensitive element was image-wise exposed and then moistened, at the emulsion side only, with the following processing solution:

| | |
|---|---|
| demineralized water | 1000 ml |
| sodium phosphate | 75 g |
| anhydrous sodium sulphite | 40 g |
| anhydrous sodium thiosulphate | 40 g |

After 3 to 5 s the moistened photosensitive element was brought in contact for 8 s with the image-receiving layer of a non-light-sensitive element, prepared by coating a paper support of 110 g/$m^2$ on both sides with polyethylene at a ratio of 15 g/$m^2$ per side, treating it with a corona discharge, and applying the following composition thereto at a ratio of 15 $m^2$/l:

| | |
|---|---|
| demineralized water | 750 ml |
| gelatin | 45 g |
| silver sulphide/nickel sulphide development nuclei | 7 g |
| 2% aqueous solution of density/tone-controlling compound | 7.5 ml |
| saponin | 10 g |
| 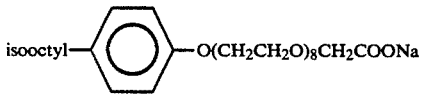 | 5 g |
| 20% aqueous formaldehyde | 8.5 ml |
| demineralized water to make | 1000 ml |

After separation of the contacting elements the transmission density ($D_{TR}$), the saturation density ($D_S$), and the reflection density ($D_{RF}$) of the transfer image were measured. Saturation density is the highest reflection density obtained in a transfer image of a step wedge. It is found in the areas of lower amounts of transferred silver.

The production of transfer images by means of the above described elements and processing solution according to the DTR-process was repeated several times in the same way except that the density- and tone-controlling compound was modified as indicated in the following Table 2. The term blank means that in that particular case no density- and tone-controlling compound was present in the image-receiving layer.

TABLE 2

| Density- and tone-controlling compound | ($D_{TR}$) | ($D_S$) | ($D_{RF}$) |
|---|---|---|---|
| Blank | 3.35 | 1.65 | 1.49 |
| Compound 1 | 3.01 | 1.94 | 1.82 |
| Compound 2 | 3.04 | 1.87 | 1.72 |
| Compound 7 | 3.00 | 1.79 | 1.62 |
| Compound 30 | 3.25 | 1.81 | 1.75 |
| Compound 34 | 3.22 | 1.90 | 1.80 |
| Compound 35 | 3.03 | 1.75 | 1.61 |
| Compound 40 | 2.99 | 1.89 | 1.79 |
| Compound 53 | 3.40 | 1.72 | 1.64 |
| Compound 68 | 2.91 | 1.83 | 1.72 |
| Compound 74 | 3.42 | 1.73 | 1.55 |

The values listed for ($D_{TR}$) in Table 2 have been obtained after deduction of 0.66 for the density of the paper support.

The results listed in Table 2 show that the reflection density ($D_{RF}$) measured on the transfer images obtained with density- and tone-controlling compounds 1, 2, 7, 30, 34, 35, 40, 53, 68, and 74 according to the present invention is higher than that of the blank. The transmission densities ($D_{TR}$) are not substantially decreased. The saturation density ($D_S$) of compounds 1, 2, 7, 30, 34, 35, 40, 53, 68, and 74 is higher than that of the blank.

EXAMPLE 2

Photosensitive elements were exposed image-wise and moistened with a processing solution, as described in Example 1.

The moistened photosensitive elements were brought in contact for 8 s with non-light-sensitive elements prepared by coating polyethylene-covered paper support as described in Example 1 with the following composition at a ratio of 1 l per 23.5 m²:

| | |
|---|---|
| demineralized water | 925 ml |

-continued

| | |
|---|---|
| gelatin | 47 g |
| silver sulphide/nickel sulphide development nuclei | 16.5 g |
| saponin | 2 g |
| density- and tone-controlling compound | $7 \times 10^{-5}$ mol/m² |

While still wet the resulting layer was coated with the following composition at a ratio of 1 l per 66 m²:

| | |
|---|---|
| demineralized water | 964 ml |
| gelatin | 20 g |
| 20% aqueous formaldehyde | 8.5 ml |
| 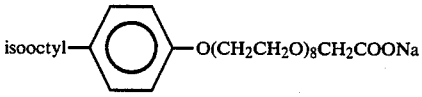 | 12 g |

After separation of the contacting elements, ($D_{TR}$), ($D_S$), and ($D_{RF}$) of the transfer images were measured.

The production of transfer images by means of the above described elements and processing solution according to the DTR-process was repeated several times in the same way, except that the density- and tone-controlling compound was modified as indicated in the following Table 3. The term blank means that in that particular case no density- and tone-controlling compound was present in the image-receiving layer.

TABLE 3

| Density- and tone-controlling compound | ($D_{TR}$) | ($D_S$) | ($D_{RF}$) | Image tone |
|---|---|---|---|---|
| Blank | 2.88 | 1.75 | 1.53 | brownish black |
| Compound 1 | 2.91 | 1.76 | 1.67 | neutral black |
| Compound 2 | 2.92 | 1.84 | 1.70 | neutral black |
| Compound 7 | 2.96 | 1.75 | 1.71 | neutral black |

The values listed for ($D_{TR}$) in Table 3 have been obtained after deduction of 0.66 for the density of the paper support.

The results listed in Table 3 show that both the reflection density ($D_{RF}$) and the transmission density ($D_{TR}$) measured on the transfer images obtained with density- and tone-controlling compounds 1, 2, and 7 according to the present invention are higher than those of the blank. The saturation density ($D_S$) of compounds 1, 2, and 7 is at least as high as that of the blank.

The tone of the transfer image obtained with the blank is brownish black, which suggests that light impinging thereon is scattered at the very surface of the image and thus gives rise to an unpleasant bronzing effect. In contrast, the tone of the transfer images obtained with compounds 1, 2, and 7 is a pleasant neutral black in consequence of the scattering of incident light on image particles that lie deeper into the transfer image.

EXAMPLE 3

Photosensitive elements were exposed image-wise and moistened with a processing solution, as described in Example 1.

The moistened photosensitive elements were brought in contact for 30 s with non-light-sensitive elements prepared by coating polyethylene-covered paper support as described in Example 1 with the following composition at a ratio of 1 l per 28.6 m²:

| | |
|---|---|
| gelatin | 34.7 g |
| silver sulphide/nickel sulphide development nuclei | 22.9 g |
| sodium isotetradecyl sulphate | 2 g |
| 20% aqueous formaldehyde | 3.7 ml |
| density- and tone-controlling compound | 40 mg/m$^2$ |
| succinimide | * |
| demineralized water in an amount sufficient to make | 1 l |

and coating the resulting image-receiving layer while still wet with the following composition for an antistress layer at a ratio of 1 l per 50 m$^2$:

| | |
|---|---|
| gelatin | 0.7 g/m$^2$ |
| 20% aqueous formaldehyde | 3.5 ml |
| sodium isotetradecyl sulphate | 10 g |
| perfluorocaprylic acid | 2 g |
| aqueous dispersion of $SiO_2$ | * |
| mixture consisting of 855 ml of aqueous dispersion (30% solids) of $SiO_2$ and 145 ml of 1 part of epoxysilane having the structural formula V given above and 19 parts of ethanol | * |
| demineralized water in an amount sufficient to make | 1 l |

*means that the amount is shown in Table 4 hereinafter.

After separation of the contacting elements, the values for ($D_{TR}$) and ($D_{RF}$) of the transfer images were measured and the colour of the light viewed in transmission through the transfer images was evaluated.

The production of transfer images by means of the above described elements and processing solution according to the DTR-process was repeated several times in the same way, except that (1) the nature of the density- and tone-controlling compound differed as shown in the following Table 4 and that (2) the amount of succinimide, the amount of aqueous dispersion of $SiO_2$, and the amount of the $SiO_2$/epoxysilane combination were as shown in Table 4. The term blank means that in that particular case no density- and tone-controlling compound, no succinimide, no aqueous dispersion of $SiO_2$, nor the $SiO_2$/epoxysilane combination were present in the image-receiving layer and the antistress layer.

TABLE 4

| Non-light-sensitive Element comprising | ($D_{TR}$) | ($D_{RF}$) | Transmitted tone |
|---|---|---|---|
| Blank — | 3.47 | 1.66 | red |
| + Compd. 7 | 3.37 | 1.67 | neutral grey |
| + Compd. 7 + 10 mg/m2 succinimide | 3.57 | 1.77 | neutral grey |
| + Compd. 7 + $SiO_2$(⅓rd of the gelatin) | 3.42 | 1.77 | neutral grey |
| + Compd. 7 + 39 mg $SiO_2$/epoxysilane mixt. | 3.49 | 1.78 | neutral grey |
| + Compd. 34 | 3.38 | 1.69 | neutral grey |
| + Compd. 34 + 10 mg/m2 succinimide | 3.63 | 1.75 | neutral grey |
| + Compd. 34 + $SiO_2$(⅓rd of the gelatin | 3.49 | 1.72 | neutral grey |
| + Compd. 34 + 39 mg $SiO_2$/epoxysilane mixt. | 3.45 | 1.80 | neutral grey |

The values listed for ($D_{TR}$) in Table 4 have been obtained after deduction of 0.66 for the density of the paper support.

The results listed in Table 4 show that the reflection density ($D_{RF}$) measured on the transfer images obtained with density- and tone-controlling compounds 7 and 34 according to the present invention is higher than that of the blank. The supplemental presence of succinimide in the image-receiving layer or of aqueous dispersion of $SiO_2$ or mixture of $SiO_2$ and epoxysilane in the antistress layer gave an even higher increase of the reflection density ($D_{RF}$). The transmission densities ($D_{TR}$) are not substantially decreased.

The tone of the transfer image obtained with the blank is red to reddish brown, which suggests that light impinging thereon is scattered at the very surface of the images and thus gives rise to an unpleasant toning effect. In contrast, the tone of the transfer images obtained with compounds 7 and 34 is a pleasant neutral grey in consequence of the scattering of incident light on image particles that lie deeper in the transfer image.

We claim:

1. Method of making a DTR-image comprising image-wise exposing a photosensitive element comprising a photographic silver halide emulsion layer, developing the exposed emulsion layer with the aid of an alkaline processing solution in the presence of a silver halide solvent and causing silver complexes to diffuse from the emulsion layer into a non-light-sensitive image-receiving layer in the presence of development nuclei thereby to form a silver transfer image in that layer, said transfer image formation occurring in the presence of at least one heterocyclic azole compound, which influences the density and tone of said transfer image, wherein said heterocyclic azole is contained in said non-light-sensitive image-receiving layer or a non-light-sensitive hydrophilic colloid layer in water-permeable relationship therewith and/or in said alkaline processing solution and is a unidentate, bidentate, or polydentate heterocyclic azole reagent for silver that does not carry a mercapto group or the tautomeric thione thereof and corresponds to the following general formula I:

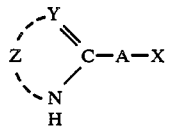

(I)

wherein:

Y represents the ring member =N— or =HC—;

Z represents the atoms completing a heterocycle, which heterocycle may carry a fused on aromatic ring system;

A represents a chemical bond or the group —($L^1$-)$_n$—Alk—($L^2$)$_m$— wherein n is 0 or 1, $L^1$ is —S—, Alk represents an alkylene group, an alkylene group interrupted by at least one hetero atom or a group containing a hetero atom, an arylene group, or an alkenylene group, m is 0 or 1, $L^2$ is —S—, —Se—, or —N($R^2$)—, wherein $R^2$ is hydrogen or a $C_1$–$C_4$alkyl group;

X represents a $C_1$–$C_{18}$alkyl group, a $C_1$–$C_{18}$alkenyl group, an aryl group, or a heterocycle, which heterocycle may carry a fused on aromatic ring system; and wherein at least one water-solubilizing group, more particularly a —COOM or —$SO_3$M group with M is hydrogen, ammonium, a metal atom, or an organic amine, can be linked directly or indirectly to the molecule of said heterocyclic azole.

2. Non-light-sensitive element for use in the DTR-process, comprising an image-receiving layer or a non-light-sensitive hydrophilic colloid layer in water-permeable relationship therewith, incorporating at least one heterocyclic azole, wherein said heterocyclic azole is a unidentate, bidentate, or polydentate heterocyclic azole corresponding to the following general formula I:

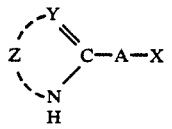

(I)

wherein:

Y represents the ring member =N— or =HC—;

Z represents the atoms completing a heterocycle, which heterocycle may carry a fused on aromatic ring system;

A represents a chemical bond or the group —$(L^1)_n$—Alk—$(L^2)_m$— wherein n is 0 or 1, $L^1$ is —S—, Alk represents an alkylene group, an alkylene group interrupted by at least one hetero atom or a group containing a hetero atom, an arylene group, or an alkenylene group, m is 0 or 1, $L^2$ is —S—, —Se—, or —N($R^2$)—, wherein $R^2$ is hydrogen or a $C_1$–$C_4$alkyl group;

X represents a $C_1$–$C_{18}$alkyl group, a $C_1$–$C_{18}$alkenyl group, an aryl group, or a heterocycle, which heterocycle may carry a fused on aromatic ring system; and wherein at least one water-solubilizing group, more particularly a —COOM or —$SO_3M$ group with M is hydrogen, ammonium, a metal atom, or an organic amine, can be linked directly or indirectly to the molecule of said heterocyclic azole.

3. A non-light-sensitive element according to claim 2, wherein said heterocyclic azole is present in said image-receiving layer in an amount ranging from 10 mg to 100 mg per $m^2$.

4. A non-light-sensitive element according to claim 2, wherein said image-receiving layer and/or said non-light-sensitive hydrophilic colloid layer in water-permeable relationship therewith also comprises at least one of the group consisting of the combination of colloidal silica and an epoxysilane, a dihydroxybenzene, and succinimide.

5. A non-light-sensitive element according to claim 4, wherein said image-receiving layer comprises succinimide and said non-light-sensitive hydrophilic colloid layer in water-permeable relationship with said image-receiving layer comprises colloidal silica and/or the combination of colloidal silica and an epoxysilane.

6. A non-light-sensitive element according to claim 4, wherein said epoxysilane corresponds to the structural formula V:

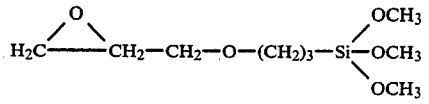

(V)

7. A non-light-sensitive element according to claim 2, wherein said element contains silver nickel sulphide development nuclei.

8. Processing solution for use in the DTR-process, comprising at least one heterocyclic azole, wherein said heterocyclic azole is a unidentate, bidentate, or polydentate heterocyclic azole compound corresponding to the following general formula I:

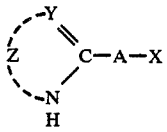

(I)

wherein:

Y represents the ring member =N— or =HC—;

Z represents the atoms completing a heterocycle, which heterocycle may carry a fused on aromatic ring system;

A represents a chemical bond or the group —$(L^1)_n$—Alk—$(L^2)_m$— wherein n is 0 or 1, $L^1$ is —S—, Alk represents an alkylene group, an alkylene group interrupted by at least one hetero atom or a group containing a hetero atom, an arylene group, or an alkenylene group, m is 0 or 1, $L^2$ is —S—, —Se—, or —N($R^2$)—, wherein $R^2$ is hydrogen or a $C_1$–$C_4$alkyl group;

X represents a $C_1$–$C_{18}$alkyl group, a $C_1$–$C_{18}$alkenyl group, an aryl group, or a heterocycle, which heterocycle may carry a fused on aromatic ring system; and wherein at least one water-solubilizing group, more particularly a —COOM or —$SO_3M$ group with M is hydrogen, ammonium, a metal atom, or an organic amine, can be linked directly or indirectly to the molecule of said heterocyclic azole.

9. A processing solution according to claim 8, wherein said heterocyclic azole is present in said processing solution in an amount ranging from 10 mg to 100 mg per liter.

* * * * *